US006186351B1

(12) United States Patent
Coyle

(10) Patent No.: US 6,186,351 B1
(45) Date of Patent: Feb. 13, 2001

(54) PORTABLE SALAD COOLER

(76) Inventor: Frank Coyle, 145 Dobbs Ave., Bellmawr, NJ (US) 08031

( * ) Notice: Under 35 U.S.C. 154(b), the term of this patent shall be extended for 0 days.

(21) Appl. No.: 09/466,083

(22) Filed: Dec. 17, 1999

(51) Int. Cl.[7] ..... A47G 19/00

(52) U.S. Cl. ..... 220/23.83; 220/23.88; 220/23.89; 220/512; 220/915.2

(58) Field of Search ..... 220/23.89, 23.88, 220/23.87, 23.86, 23.83, 507, 512, 574.2, 575, 915.2, 915.1, 737; 206/370, 372, 804, 593

(56) References Cited

U.S. PATENT DOCUMENTS

| | | | | |
|---|---|---|---|---|
| 771,140 | * | 9/1904 | Galer . | |
| 2,627,993 | * | 2/1953 | Hafner . | |
| 2,666,551 | * | 1/1954 | Wyman . | |
| 2,740,546 | * | 4/1956 | Kowalski . | |
| 3,052,508 | * | 9/1962 | Fink . | |
| 3,777,882 | * | 12/1973 | McIntyre . | |
| 5,004,103 | * | 4/1991 | Connors et al. | 206/372 |
| 5,271,520 | * | 12/1993 | McAfee | 220/529 |
| 5,333,751 | * | 8/1994 | Santucci, Sr. | 206/423 |
| 5,912,033 | * | 6/1999 | Ferguson | 426/124 |
| 6,050,663 | * | 4/2000 | Schoellmann | 312/408 |

* cited by examiner

*Primary Examiner*—Stephen Castellano

(57) ABSTRACT

A portable salad cooler for storing and transporting salads, condiments and vegetables. The portable salad cooler includes a chest has an open top, a bottom wall and a perimeter side wall upwardly extending around the bottom wall. A lid substantially covers the open top of the chest. The perimeter side wall of the chest has an inwardly extending shelf lip extending therearound into the chest. A tray is disposed in the chest and is rested on the lip. The tray has plurality of receiving holes therethrough. A plurality of storage containers are provided each having a removable top lid with an outwardly extending resting lip therearound. Each of the storage containers is associated with a corresponding receiving hole of the tray into which the storage container is inserted so that the resting lips of the storage containers rest on the tray.

9 Claims, 3 Drawing Sheets

PORTABLE SALAD COOLER

BACKGROUND OF THE INVENTION

1. Field of the Invention

The present invention relates to portable salad coolers and more particularly pertains to a new portable salad cooler for storing and transporting salads, condiments and vegetables.

2. Description of the Prior Art

The use of portable salad coolers is known in the prior art. More specifically, portable salad coolers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,280,336; U.S. Pat. No. 4,286,440; U.S. Pat. No. 3,800,554; U.S. Pat. No. 4,974,426; U.S. Pat. No. 4,873,841; and U.S. Pat. No. 5,622,059.

While these devices fulfill their respective, particular objectives and requirements, the aforementioned patents do not disclose a new portable salad cooler. The inventive device includes a chest has an open top, a bottom wall and a perimeter side wall upwardly extending around the bottom wall. A lid substantially covers the open top of the chest. The perimeter side wall of the chest has an inwardly extending shelf lip extending therearound into the chest. A tray is disposed in the chest and is rested on the lip. The tray has plurality of receiving holes therethrough. A plurality of storage containers are provided each having a removable top lid with an outwardly extending resting lip therearound. Each of the storage containers is associated with a corresponding receiving hole of the tray into which the storage container is inserted so that the resting lips of the storage containers rest on the tray.

In these respects, the portable salad cooler according to the present invention substantially departs from the conventional concepts and designs of the prior art, and in so doing provides an apparatus primarily developed for the purpose of storing and transporting salads, condiments and vegetables.

SUMMARY OF THE INVENTION

In view of the foregoing disadvantages inherent in the known types of portable salad coolers now present in the prior art, the present invention provides a new portable salad cooler construction wherein the same can be utilized for storing and transporting salads, condiments and vegetables.

The general purpose of the present invention, which will be described subsequently in greater detail, is to provide a new portable salad cooler apparatus and method which has many of the advantages of the portable salad coolers mentioned heretofore and many novel features that result in a new portable salad cooler which is not anticipated, rendered obvious, suggested, or even implied by any of the prior art portable salad coolers, either alone or in any combination thereof.

To attain this, the present invention generally comprises a chest has an open top, a bottom wall and a perimeter side wall upwardly extending around the bottom wall. A lid substantially covers the open top of the chest. The perimeter side wall of the chest has an inwardly extending shelf lip extending therearound into the chest. A tray is disposed in the chest and is rested on the lip. The tray has plurality of receiving holes therethrough. A plurality of storage containers are provided each having a removable top lid with an outwardly extending resting lip therearound. Each of the storage containers is associated with a corresponding receiving hole of the tray into which the storage container is inserted so that the resting lips of the storage containers rest on the tray.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable salad cooler apparatus and method which has many of the advantages of the portable salad coolers mentioned heretofore and many novel features that result in a new portable salad cooler which is not anticipated, rendered obvious, suggested, or even implied by any of the prior art portable salad coolers, either alone or in any combination thereof.

It is another object of the present invention to provide a new portable salad cooler which may be easily and efficiently manufactured and marketed.

It is a further object of the present invention to provide a new portable salad cooler which is of a durable and reliable construction.

An even further object of the present invention is to provide a new portable salad cooler which is susceptible of a low cost of manufacture with regard to both materials and labor, and which accordingly is then susceptible of low prices of sale to the consuming public, thereby making such portable salad cooler economically available to the buying public.

Still yet another object of the present invention is to provide a new portable salad cooler which provides in the apparatuses and methods of the prior art some of the advantages thereof, while simultaneously overcoming some of the disadvantages normally associated therewith.

Still another object of the present invention is to provide a new portable salad cooler for storing and transporting salads, condiments and vegetables.

Yet another object of the present invention is to provide a new portable salad cooler which includes a chest has an open top, a bottom wall and a perimeter side wall upwardly extending around the bottom wall. A lid substantially covers the open top of the chest. The perimeter side wall of the chest has an inwardly extending shelf lip extending therearound into the chest. A tray is disposed in the chest and is rested on the lip. The tray has plurality of receiving holes therethrough. A plurality of storage containers are provided each having a removable top lid with an outwardly extending resting lip therearound. Each of the storage containers is associated with a corresponding receiving hole of the tray into which the storage container is inserted so that the resting lips of the storage containers rest on the tray.

Still yet another object of the present invention is to provide a new portable salad cooler that helps keep salads cool and fresh during picnicking.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
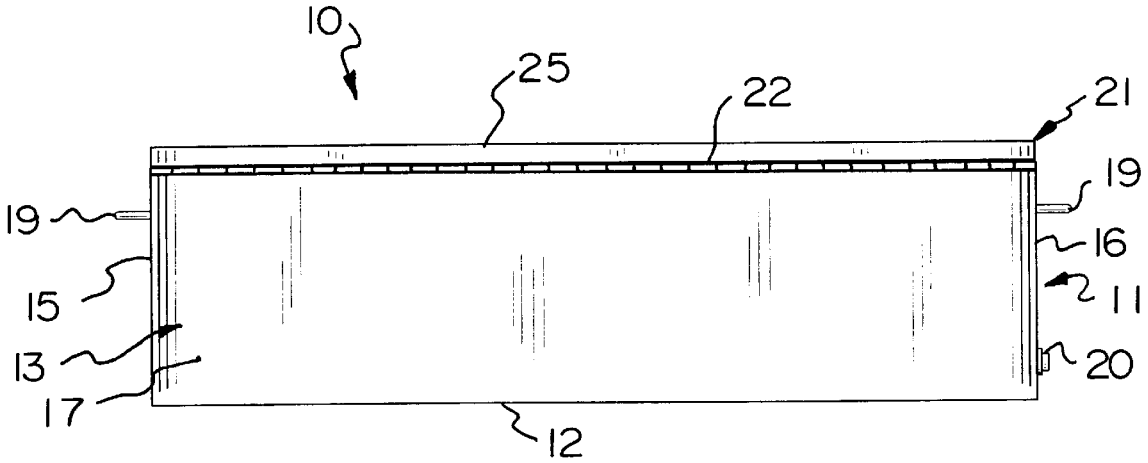
FIG. 1 is a schematic back side view of a new portable salad cooler according to the present invention.
Figure 2:
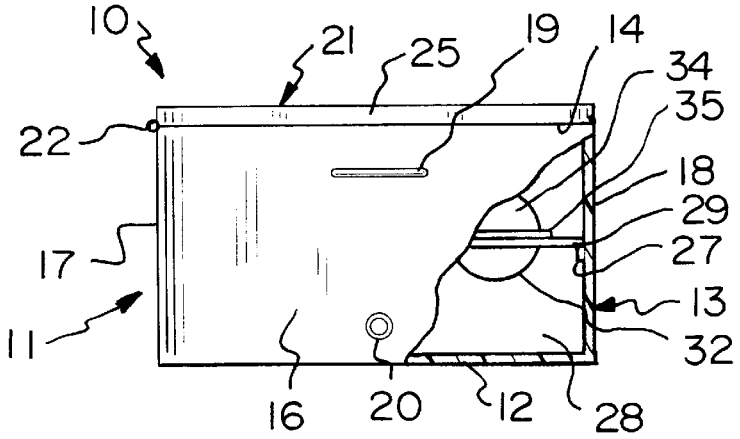
FIG. 2 is a schematic breakaway end view of the present invention.
Figure 3:
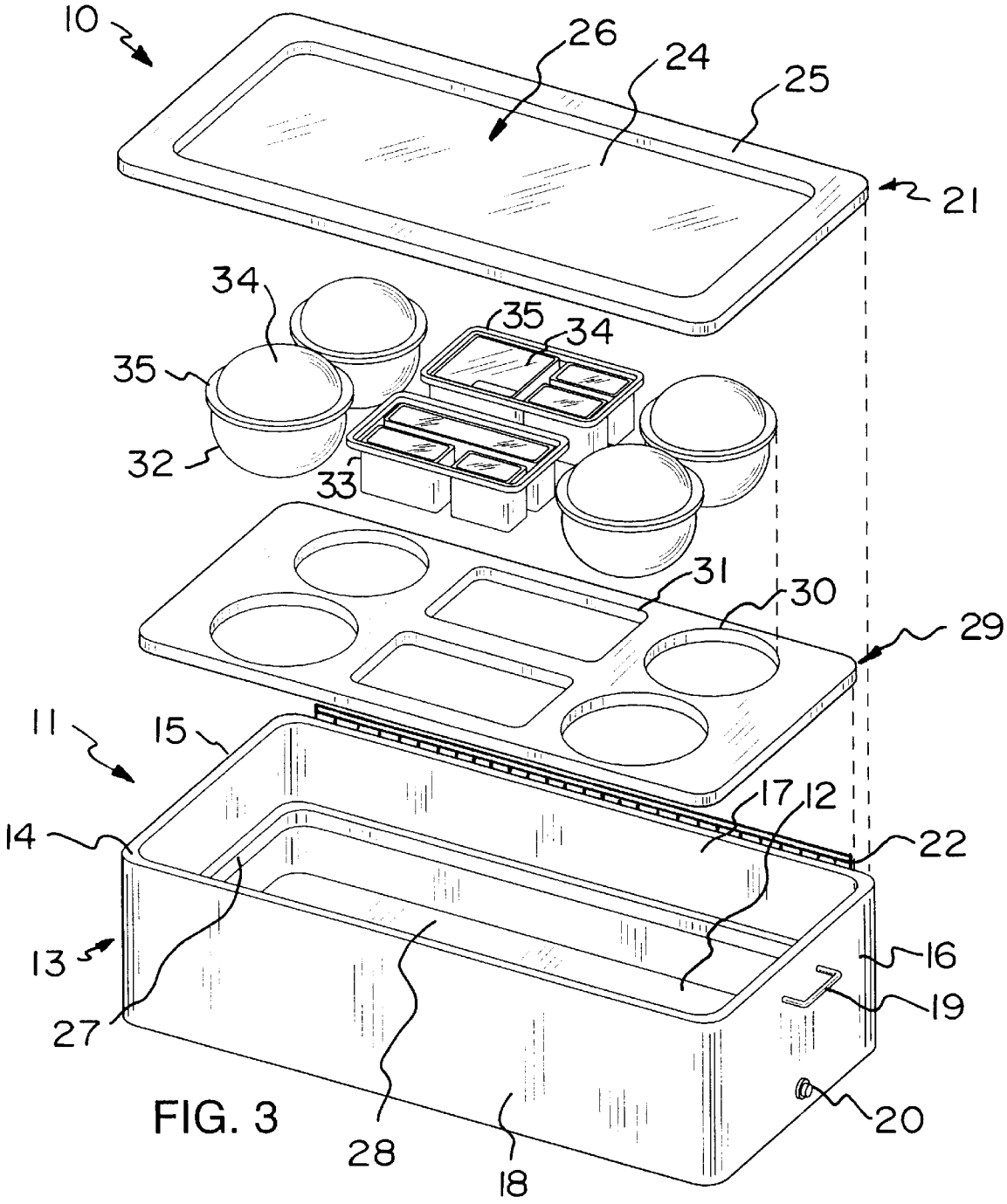
FIG. 3 is a schematic exploded front perspective view of the present invention.
Figure 4:
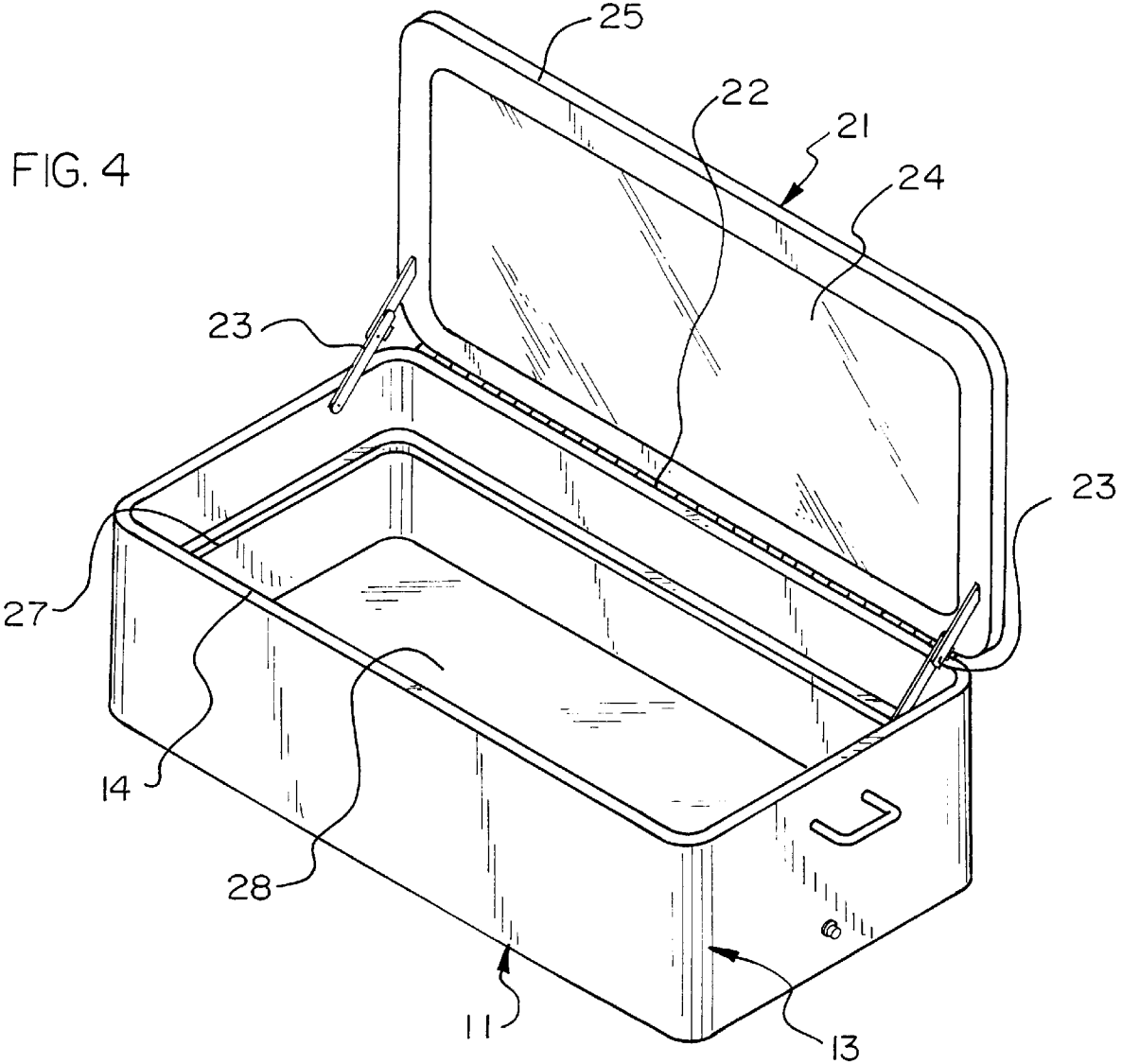
FIG. 4 is a schematic top perspective view of the present invention with the lid pivoted open to expose the open top of the chest.

With reference now to the drawings, and in particular to FIGS. 1 through 4 thereof, a new portable salad cooler embodying the principles and concepts of the present invention and generally designated by the reference numeral 10 will be described.

As best illustrated in FIGS. 1 through 4, the portable salad cooler 10 generally comprises a chest has an open top, a bottom wall and a perimeter side wall upwardly extending around the bottom wall. A lid substantially covers the open top of the chest. The perimeter side wall of the chest has an inwardly extending shelf lip extending therearound into the chest. A tray is disposed in the chest and is rested on the lip. The tray has plurality of receiving holes therethrough. A plurality of storage containers are provided each having a removable top lid with an outwardly extending resting lip therearound. Each of the storage containers is associated with a corresponding receiving hole of the tray into which the storage container is inserted so that the resting lips of the storage containers rest on the tray.

In closer detail the portable salad cooler 10 includes a generally rectangular chest 11 having an open top, a bottom wall 12 and a perimeter side wall 13 upwardly extending around the bottom wall. The perimeter side wall of the chest has an upper edge 14 which defines the open top of the chest, a spaced apart pair of end panels 15,16, and a spaced apart pair of side panels 17,18 extending between the end panels of the perimeter side wall.

Each of the end panels of the perimeter side wall may have an outwardly extending handle 19 coupled thereto. One of the end panels of the perimeter side wall may also have a drain hole 20 therethrough for permitting draining of water from the chest with a plug for closing the drain hole.

The cooler also includes a lid 21 substantially covering the open top of the chest. The lid is pivotally coupled to the upper edge of the perimeter side wall along one of the side panels of the perimeter side wall. In one embodiment, a piano-type hinge 22 pivotally couples the lid to the upper edge of the perimeter side wall. In one such an embodiment, a pair of scissors hinges 23 may also be included to further pivotally couple the lid to the insides of the end panels of the perimeter side wall. The scissors hinges is designed for permitting holding the lid in a open position to uncover the open top of the chest.

The lid may comprise a generally rectangular center window portion 24 and an outer frame portion 25 around the center window portion. The center window portion comprises a translucent or transparent material such as the material sold under the tradename PLEXIGLAS or PERSPEX. The center window portion permits viewing into the chest when the lid covers the open top of the chest.

In one such embodiment, the center window portion may also lie in a plane below an upper surface of the outer frame portion such that a generally rectangular upper central depression 26 is formed in the lid.

The perimeter side wall of the chest has an inwardly extending shelf lip 27 extending therearound into the chest. The shelf lip lies in plane located between the upper edge of the perimeter side wall and the bottom wall of the chest. The plane of the shelf lip may be substantially parallel to the bottom wall and to a plane in which the upper edge of the perimeter side wall. The shelf lip defines therebelow a lower compartment 28 in the chest designed for holding therein cooling materials such as ice, or cooling packs for keeping items stored in the chest cool.

A generally rectangular and substantially planar tray 29 is disposed in the chest and rested on the lip such that the tray is spaced above the bottom wall of the chest in a plane parallel to the bottom wall. The tray has plurality of receiving holes therethrough. The plurality of receiving holes may include four circular receiving holes 30 and a pair of rectangular receiving holes 31. The rectangular receiving holes may be positioned on the tray between a first pair and a second pair of the circular receiving holes.

The cooler also includes a plurality of storage containers 32,33 each having a top opening and a removable top lid 34 covering the top opening of the respective storage container. The top lid of each storage container has an outwardly extending resting lip 35 therearound. The storage containers may also each comprise a translucent or a transparent material.

Each of the storage containers is associated with a corresponding receiving hole of the tray. Each storage container is inserted into the respective corresponding receiving hole.

The resting lips of the storage containers rest on the tray when the storage containers are inserted into the receiving holes.

In one embodiment, the plurality of storage containers may comprise four generally spherical salad storage containers 32, and a pair of compartmentalized storage containers 33. Each of the compartmentalized storage containers has a plurality of separate compartments therein for holding items therein separate from one another.

In this embodiment, each of the salad storage containers is associated with a corresponding one of the circular receiving holes of the tray. Each salad storage container is inserted through the respective corresponding circular receiving holes. The resting lips of the top lids of the salad storage containers each is generally circular and has a diameter greater than an outer diameter of the respective corresponding circular receiving hole. The resting lips of the top lids of the salad storage containers are rested on the tray when the salad storage containers are inserted into the circular receiving holes.

Further, in this embodiment, each of the compartmentalized storage containers is associated with a corresponding one of the rectangular receiving holes of the tray. Each compartmentalized storage container is inserted through the respective corresponding rectangular receiving holes. The resting lips of the top lids of the compartmentalized storage containers each is generally rectangular and is rested on the tray when the compartmentalized storage containers are inserted into the rectangular receiving holes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooler, comprising:

a chest having an open top, a bottom wall and a perimeter side wall upwardly extending around said bottom wall;

a lid substantially covering said open top of said chest;

said perimeter side wall of said chest having an inwardly extending shelf lip extending therearound into said chest;

a tray being disposed in said chest and rested on said lip;

said tray having plurality of receiving holes therethrough;

a plurality of storage containers each having a removable top lid, said top lid of each storage container having an outwardly extending resting lip therearound;

each of said storage containers being associated with a corresponding receiving hole of said tray;

each storage container being inserted into the respective corresponding receiving hole; and said resting lips of said storage containers resting on said tray when said storage containers are inserted into said receiving holes.

2. The cooler of claim 1, wherein said perimeter side wall has a pair of outwardly extending handle coupled thereto.

3. The cooler of claim 1, wherein said perimeter side wall has a drain hole therethrough.

4. The cooler of claim 1, wherein said lid is pivotally coupled to said perimeter side wall.

5. The cooler of claim 1, wherein said lid comprises a center window portion and an outer frame portion around said center window portion.

6. The cooler of claim 1, wherein said plurality of receiving holes includes a plurality of circular receiving holes and a pair of rectangular receiving holes.

7. The cooler of claim 6, wherein said rectangular receiving holes are positioned on said tray between a first pair and a second pair of said circular receiving holes.

8. The cooler of claim 6, wherein said plurality of storage containers comprises a plurality of salad storage containers, and a pair of compartmentalized storage containers, each of said salad storage containers being associated with a corresponding one of said circular receiving holes of said tray, each salad storage container being inserted through the respective corresponding circular receiving holes, each of said compartmentalized storage containers being associated with a corresponding one of said rectangular receiving holes of said tray, each compartmentalized storage container being inserted through the respective corresponding rectangular receiving holes.

9. A cooler, comprising:

a generally rectangular chest having an open top, a bottom wall and a perimeter side wall upwardly extending around said bottom wall;

said perimeter side wall of said chest having an upper edge defining said open top of said chest, a spaced apart pair of end panels, and a spaced apart pair of side panels extending between said end panels of said perimeter side wall;

each of said end panels of said perimeter side wall having an outwardly extending handle coupled thereto;

one of said end panels of said perimeter side wall having a drain hole therethrough and a plug closing said drain hole;

a lid substantially covering said open top of said chest;

said lid being pivotally coupled to said upper edge of said perimeter side wall along one of said side panels of said perimeter side wall;

said lid comprising a generally rectangular center window portion and an outer frame portion around said center window portion;

said perimeter side wall of said chest having an inwardly extending shelf lip extending therearound into said chest;

said shelf lip lying in plane located between said upper edge of said perimeter side wall and said bottom wall of said chest;

a generally rectangular and substantially planar tray being disposed in said chest and rested on said lip such that said tray is spaced above said bottom wall of said chest in a plane parallel to said bottom wall;

said tray having plurality of receiving holes therethrough;

said plurality of receiving holes including four circular receiving holes and a pair of rectangular receiving holes;

said rectangular receiving holes being positioned on said tray between a first pair and a second pair of said circular receiving holes;

a plurality of storage containers each having a top opening and a removable top lid covering said top opening of the respective storage container;

said top lid of each storage container having an outwardly extending resting lip therearound;

said plurality of storage containers comprising four salad storage containers, and a pair of compartmentalized storage containers;

each of said compartmentalized storage containers having a plurality of separate compartments therein for holding items therein separate from one another;

each of said salad storage containers being associated with a corresponding one of said circular receiving holes of said tray;

each salad storage container being inserted through the respective corresponding circular receiving holes;

said resting lips of said top lids of said salad storage containers each being generally circular and having a diameter greater than an outer diameter of the respective corresponding circular receiving hole;

said resting lips of said top lids of said salad storage containers resting on said tray when said salad storage containers are inserted into said circular receiving holes;

each of said compartmentalized storage containers being associated with a corresponding one of said rectangular receiving holes of said tray;

each compartmentalized storage container being inserted through the respective corresponding rectangular receiving holes; and said resting lips of said top lids of said compartmentalized storage containers each being generally rectangular and being rested on said tray when said compartmentalized storage containers are inserted into said rectangular receiving holes.

* * * * *